United States Patent [19]

Fields

[11] 4,427,386

[45] Jan. 24, 1984

[54] ARTILLERY TRAINING AID

[76] Inventor: Max H. Fields, 1609 Ridgewood Ave., Greensboro, N.C. 27405

[21] Appl. No.: 336,938

[22] Filed: Jan. 4, 1982

[51] Int. Cl.[3] ..... F41G 3/26
[52] U.S. Cl. ..... 434/19
[58] Field of Search ..... 434/19, 16, 11; 33/292

[56] References Cited

U.S. PATENT DOCUMENTS

| | | | |
|---|---|---|---|
| 555,231 | 2/1896 | Berger | 33/292 |
| 1,803,064 | 4/1931 | Karnes et al. | 434/19 |
| 2,471,368 | 5/1949 | Ekstrom et al. | 434/19 |

OTHER PUBLICATIONS

Keuffel and Esser Catalog, p. 7 and title page 1929.

*Primary Examiner*—William H. Grieb

[57] ABSTRACT

The invention disclosed herein demonstrates a training aid for use by field artillery instructors and others in developing gun section personnel and teaching them techniques, tests and adjustments for sighting artillery weapons. Boresighting, direct and indirect laying of the artillery piece along with other useful techniques can be taught with the use of the present invention which includes a rotatable stanchion, a tube, a gear drive for rotating the stanchion and sight support structures.

7 Claims, 4 Drawing Figures

ARTILLERY TRAINING AID

BACKGROUND AND OBJECTIVES OF THE PRESENT INVENTION

The armed services have to continually train new personnel in the use of combat support weapons such as the 175-MM gun, howitzers and other artillery pieces to insure a combat ready defense system. Special schools have been set up for training troops correct procedures to employ while using artillery. Both classroom and field training is required and the training is often times difficult for the student and is always expensive for the government. Bad weather can make field training inconvenient or impossible, and such training is often unavailable to distant reserve units which may be based hundreds of miles from training facilities. Classroom work can provide assistance to artillery trainees, but often times the classroom study does not properly benefit the student and too little time may be spent to insure each trainee has developed proper operational techniques. Consequently, additional time and effort must be spent by section chiefs to insure that those under his command are properly trained.

With knowledge of the disadvantages and inefficiency of current training procedures the present invention was developed and one of its main objectives is to provide a realistic training aid to the classroom student.

Another objective of the present invention is to provide a training aid which will assist instructors during classroom sessions.

Yet another objective of the present invention is to lower the training costs for artillery gunners by allowing them to perfect their techniques on classroom prototypes.

Still another objective of the present invention is to provide a training aid which can be used during inclement weather or otherwise when field training is impractical.

It is also an objective of the present invention to provide a training aid which will allow groups of students to be rapidly trained in accurate methods of artillery procedures.

DESCRIPTION OF THE PREFERRED EMBODIMENT

The invention in its preferred form comprises a base having leg members and leveling means attached to said leg members. Also affixed to the base is a leveling vial and a traversing means is rotatably connected to the stanchion. The stanchion includes an external sleeve which is connected to said base and within the sleeve is a rotatable shaft which is joined at its upper end to a platform member. The platform member includes a panoramic telescope mount and an elbow telescope mount. Also positioned on the platform member are a pair of tube member support members. A tube member having a gunner's quadrant mount and a trunnion is adjustably joined to the tube member support members. Thus, as the traversing means is rotated the tube member can be laterally directed and the elevation of the tube member can be changed by pivoting the trunnion member which is joined thereto.

Figure 1:
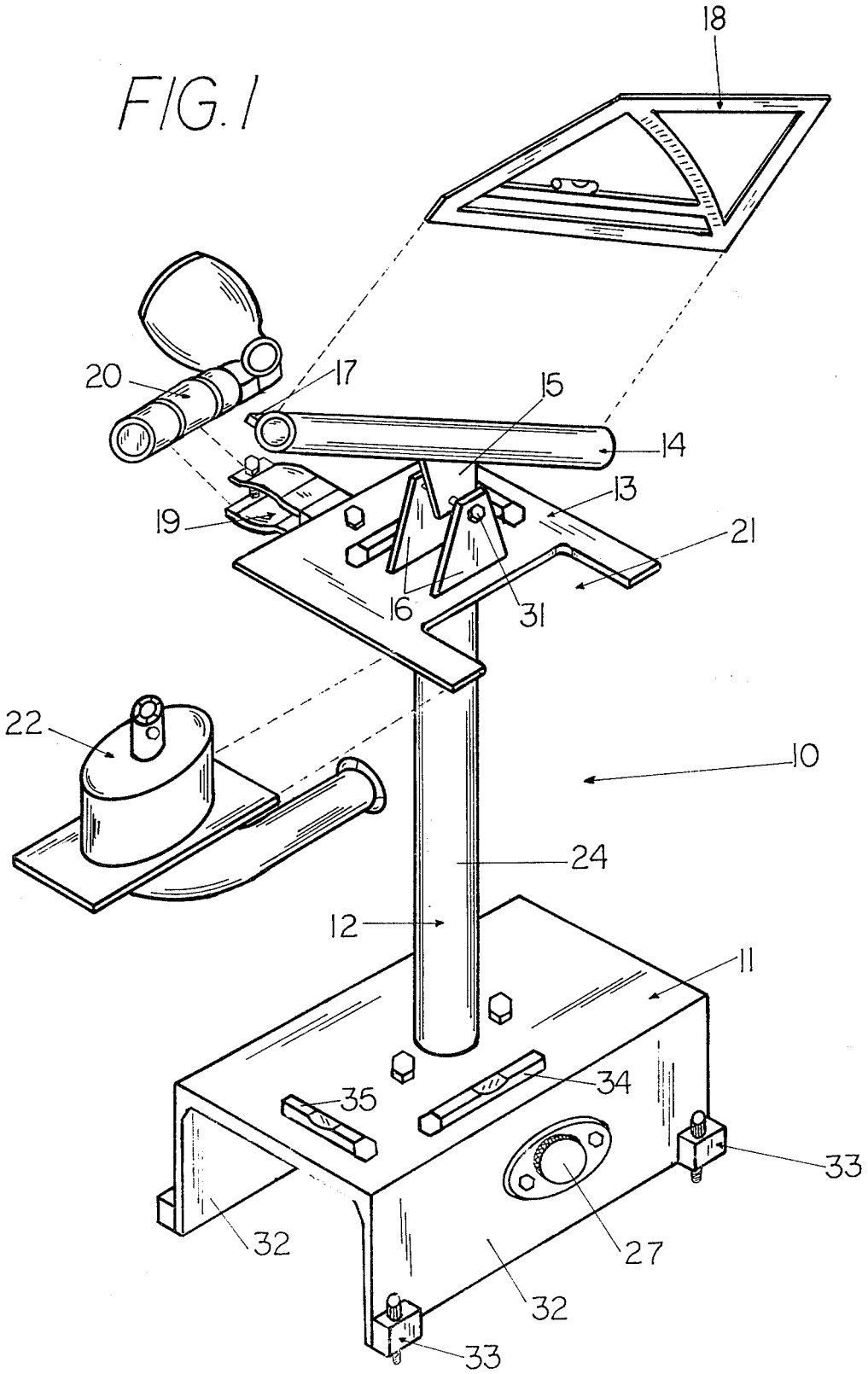
FIG. 1 is a perspective view of the artillery training aid with the gunner's quadrant and scope unattached.

For a more detailed description of the drawings, training aid 10 as shown in FIG. 1 includes a base 11, a stanchion 12 and a platform member 13. Shown positioned above platform member 13 is tube member 14 which is adjustably connected to platform member 13. Trunnion member 15 is adjustably joined to tube member support member 16 and the adjustable mounting of tube member 14 allows for changes in the elevation of tube member 14. Also positioned on tube member 14 is quadrant mounting means 17 and unattached to quadrant mounting means 17 is a typical gunner'quadrant 18 which can be mounted and dismounted as required by students during use of the training aid. Also shown on platform member 13 is bracket means 19 which is used to grip elbow telescope 20 also shown independent of bracket means 19 since elbow scope 20 can be positioned on training aid 10 or removed as desired.

On the opposite side of platform member 13 from bracket means 19 is scope mounting means notch 21 into which panoramic telescope 22 will rest.

Figure 2:
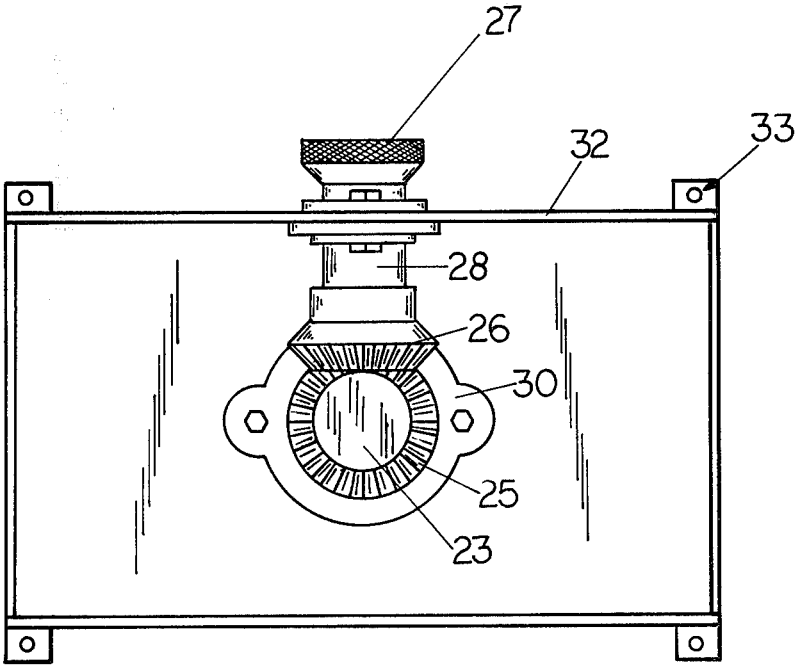
FIG. 2 is a bottom view of the base of the training aid.
Figure 3:
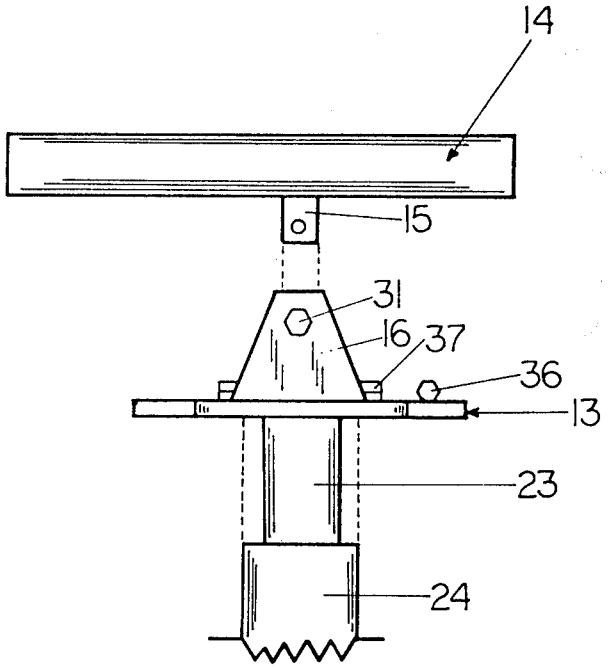
FIG. 3 is an exploded view of the upper portion of the training aid.
Figure 4:
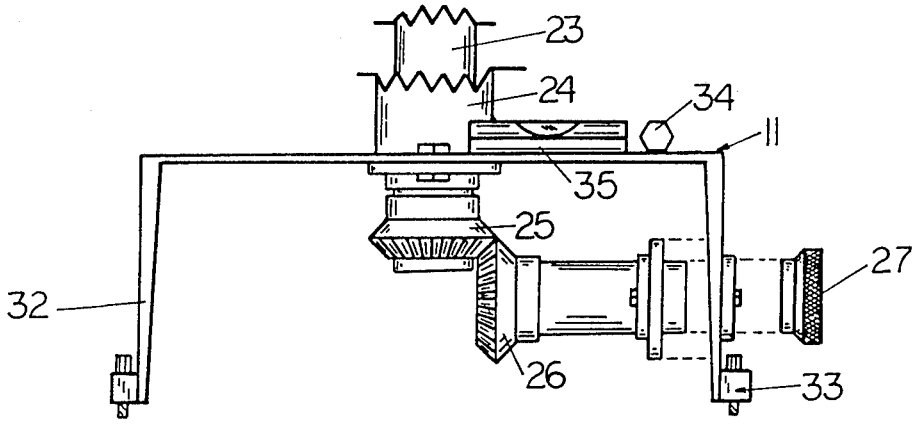
FIG. 4 demonstrates the lower portion of the training aid in disassembled fashion.

Platform member 13 and its accouterments are rotatable since platform member 13 is affixed to the upper end of shaft 23 as shown more clearly in FIG. 3. Stanchion 12 has an outer sleeve 24 which is joined to base 11 through which the lower end of shaft 23 passes as shown in FIG. 4. At the lower end of shaft 23 is attached first gear means 25 which may be for example, a beveled gear. Enmeshed with first gear means 25 is second gear means 26 as shown in FIG. 2 which is joined to traversing knob 27 by gear shaft 28. Bearing members 29 and 30 insure smooth turning of respectively, gear shaft 29 and stanchion shaft 23. Thus, tube member 14 can be directed to a particular azimuth reading by rotating traversing knob 27 in either a clockwise or counter-clockwise direction as required. The attitude of elevation tube member 14 can be changed by loosening adjusting means 31 as shown in FIG. 3 and tilting tube member 14 as required. Thereafter, tightening adjusting means 31 insures the desired attitude of tube member 14 during sighting exercises.

In order to insure correct sightings, base means 11 must be level and leveling means 33 are provided on leg member 32. In order to verify that base 11 is level, leveling vials 34 and 35 are shown mounted on base 11. Additional leveling vials 36 and 37 are shown on platform member 13 which may be used, for example, by the assistant gunner to verify or check the gunner's leveling procedures.

In use the training aid would first be mounted with a panoramic or scope 22 or similar sighting device as shown in FIG. 1. Thereafter, elbow sight 20 would be properly positioned within bracket means 19. Next, base 11 would be leveled to insure accuracy of the practice trajectory. Thereafter, gunner'quadrant 18 would be placed on quadrant mounting means 17 which is a flat support along the side of tube member 14 as shown in FIG. 1, and tube member 14 would be adjusted to the given attitude. Thereafter, the azimuth of tube member 14 would be set whereupon the instructor could then check the student's ability to carry out instructions whereupon further instructions would be given or other students would be offered the opportunity to properly "lay the piece" by using training aid 10.

Various changes or modifications can be made to the training aid as shown herein and the illustrations and examples are for illustrative purposes and are not intended to limit the scope of the invention.

I claim:

1. A training aid comprising: a base, having a leg member, a leveling means, said leveling means attached to said leg member, a rotatable staunchion, said staunchion including a gear means, said staunchion joined to said base member at its lower end, a platform member, said platform member joined to the upper end of said staunchion, a tube member, and a trunnion member, said trunnion member adjustably connecting said tube member to said platform member.

2. A training aid as claimed in claim 1 and including a quadrant mounting means affixed to said tube means.

3. A training aid as claimed in claim 1 wherein said base includes a traversing means.

4. A training aid as claimed in claim 1 wherein said platform member includes a tube means support member.

5. A training aid as claimed in claim 1 wherein said rotatable stanchion includes sleeve means and a rotatable shaft member.

6. A training aid as claimed in claim 1 wherein said platform member includes a scope mounting means.

7. A training aid comprising: a base having a leg member, leveling means, said leveling means affixed to said leg member, a rotatable stanchion, said stanchion joined to said base member at its lower end, a platform member, said platform member joined to the upper end of said stanchion, said platform member including a tube member support member, a tube member, said tube member having a trunnion member, said trunnion member adjustably joined to said tube member support member, said stanchion including a rotatable shaft, first gear means, said first gear means joined to the lower end of said shaft, second gear means, said second gear means meshed with said first gear means, traversing means, said traversing means rotatably fixed to said base and said traversing means joined to said second gear means whereby turning said traversing means rotates said stanchion.

* * * * *